United States Patent [19]

Holz et al.

[11] Patent Number: 4,741,808

[45] Date of Patent: May 3, 1988

[54] COKE OVEN DOOR

[75] Inventors: Wilhelm Holz, Gelsenkirchen-Buer; Helmut Lukaszewicz, Bottrop; Friedhelm Haaf, Velbert, all of Fed. Rep. of Germany; Mutien-Marie Renverse, Tournai, Belgium

[73] Assignee: Krupp Polysius AG, Beckum, Fed. Rep. of Germany

[21] Appl. No.: 908,635

[22] Filed: Sep. 18, 1986

Related U.S. Application Data

[63] Continuation of Ser. No. 664,699, Oct. 25, 1984, abandoned.

[30] Foreign Application Priority Data

Nov. 10, 1983 [DE] Fed. Rep. of Germany ..... 3340731

[51] Int. Cl.[4] ..... C10B 25/06

[52] U.S. Cl. ..... 202/248; 202/269

[58] Field of Search ..... 202/242, 248, 269, 270; 110/173 R

[56] References Cited

U.S. PATENT DOCUMENTS 4,067,778 1/1978 Van Ackeren et al. ..... 202/269

FOREIGN PATENT DOCUMENTS

| | | | |
|---|---|---|---|
| 918931 | 10/1954 | Fed. Rep. of Germany | 202/269 |
| 1034137 | 7/1956 | Fed. Rep. of Germany . | |
| 1091982 | 11/1960 | Fed. Rep. of Germany . | |
| 2755020 | 6/1979 | Fed. Rep. of Germany . | |
| 3044703 | 6/1982 | Fed. Rep. of Germany . | |
| 9035402 | 4/1974 | Japan | 202/269 |
| 883144 | 11/1981 | U.S.S.R. | 202/269 |

OTHER PUBLICATIONS

Lowrie et al., U.S. Department of Commerce (N.I.T.S.), PB-245-580, "Study of Concepts for Minimizing Emissions from Coke Oven Door Seals", 7-1975.

*Primary Examiner*—Peter Kratz

*Attorney, Agent, or Firm*—Learman & McCulloch

[57] ABSTRACT

The invention relates to a coke oven door with a sealing element which consists of a metal sealing strip and a crowned metal diaphragm. When the sealing strip is pressed onto the door frame a wedge-shaped gap is produced between the sealing strip and the door frame into which the tarry condensation residues pass as a result of the movement of the sealing strip and ensure a good seal.

8 Claims, 3 Drawing Sheets

COKE OVEN DOOR

This is a continuation of application Ser. No. 664,699, filed on Oct. 25, 1984, now abandoned.

Coke oven doors are known in which the sealing strips are pressed onto the door frame by a plurality of springs (German Auslegeschrift No. 1 034 137, German Offenlegungsschrift No. 27 55 020). Versions are also known in which additional lever systems are used in order to press the sealing strips onto the door frame (German Auslegeschrift No. 10 91 982). The essential disadvantage of these versions lies in their complicated and costly construction.

It is also known to fix metal sealing strips onto the door body by means of screw hooks via a rigid U iron. The essential disadvantage of this construction lies in the insecure sealing caused by the absence of springs.

In the previously known means for sealing coke oven doors the tarry distillation products which condense in the region of the sealing strip also play a significant part in the sealing during operation. However, the tarry residues on the door frame and on the sealing strips are removed after each oven charging operation and therefore in the known constructions, even if there is a resilient metal seal, optimum sealing cannot be achieved, at least directly after the oven chamber has been filled, because at first there is no tar mist condensation.

The object of the invention, therefore, is to avoid these disadvantages and provide a coke oven door which, in spite of its simple construction, ensures a satisfactory seal after closure of the door.

This object is achieved by the provision of a metal, lid-shaped diaphragm which is clamped at its inner edge on the door stop support and supports the sealing strip on its outer edge and is prestressed by a few millimeters when the door is locked. Thus a wedge-shaped gap which is open towards the exterior of the oven forms between the sealing strip and the door frame. At the same time the sealing strip moves outwards somewhat—caused by the deformation of the diaphragm—that is to say, in the direction in which the said wedge-shaped gap widens. The consequence of this is that the tarry condensation residues present on the door frame are pushed into the wedge-shaped gap of the outwardly-moving sealing strip. In this way it is ensured that even before the oven chamber is filled there is sufficient sealing material available to prevent emissions in the region of the sealing strip.

Figure 1:
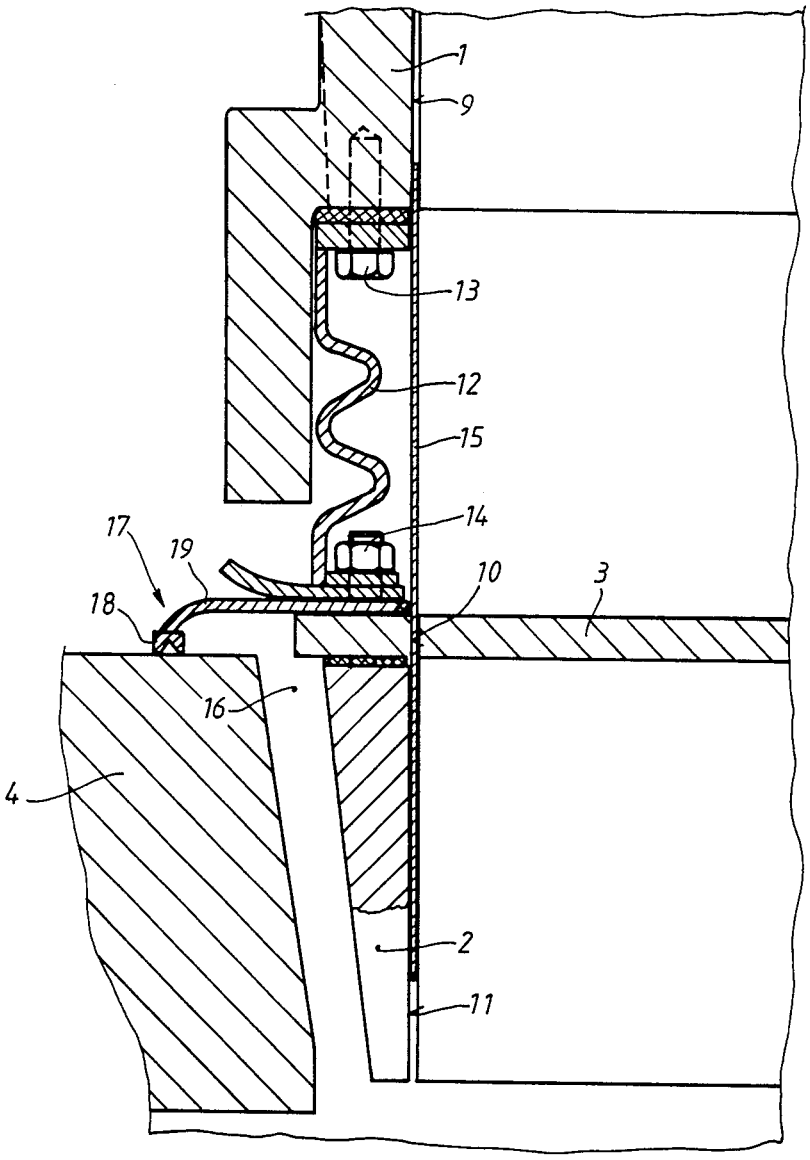

Advantageous embodiments of the invention are explained in greater detail below in connection with the description of one embodiment illustrated in the drawings, wherein FIG. 1 shows a partial section through the coke oven door according to the invention in the region of the levelling opening.

Figure 2:
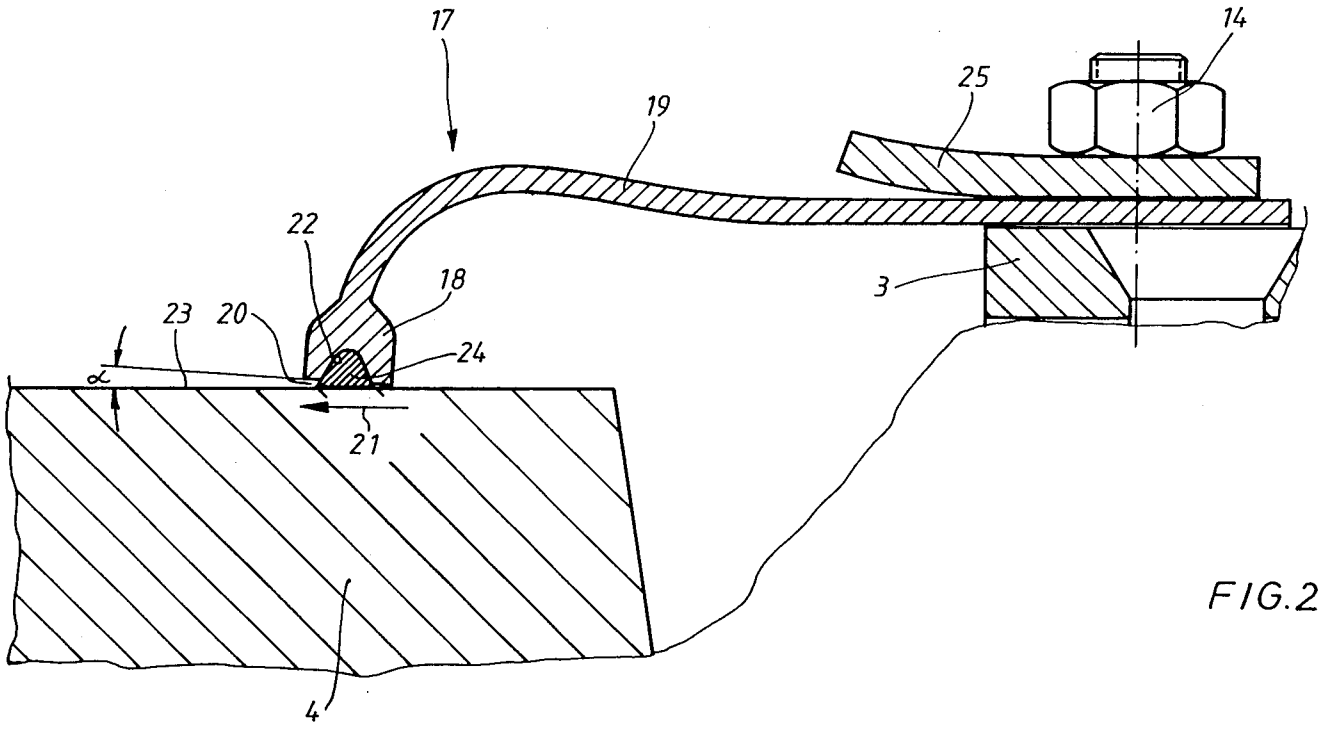
Figure 3:
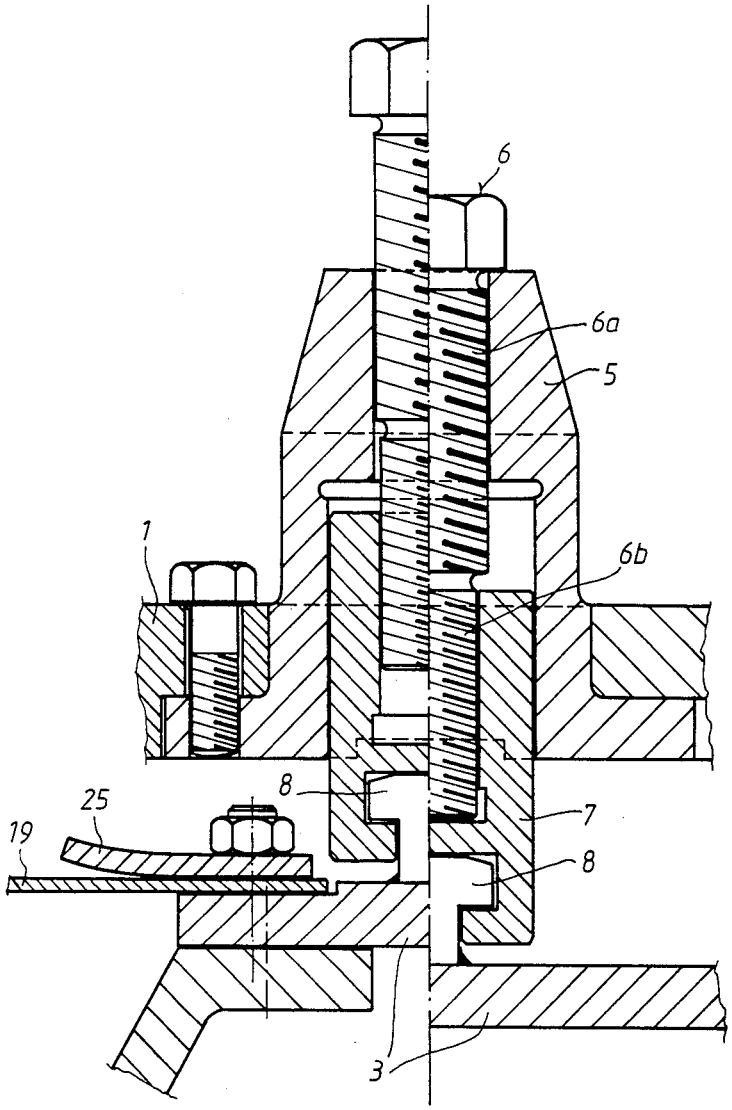

FIG. 2 shows a partial representation of FIG. 1 (to explain the deformation of the diaphragm and the movement aof the sealing strip on clamping and locking of the door body), and FIG. 3 shows a partial section through the door in order to explain the relative displacement of the door body and door stop support.

The coke oven door which is only partially illustrated in the drawings contains a door body 1, a door stop 2 and a door stop support 3. The connection between the door body 1 and the door stop support 3 will be explained in greater detail with the aid of FIG. 3.

Clamping and locking arrangements which are not shown in detail serve to clamp and lock the door body 1 relative to a stationary door frame 4.

FIG. 3 shows the adjustable connection between the door body 1 and the door stop support 3. The door body 1 is provided with an adjustment support 5 (a limited number of such adjustment supports 5 are provided, of course, over the entire periphery of the coke oven door). In this adjustment support 5 a spindle 6 is movable in the longitudinal direction by means of a first threaded section *6a*. A retaining piece 7 which at its lower end encloses an engaging piece 8 of T-shaped cross-section is located on a second threaded section *6b* of the spindle 6 which has a different thread pitch from the threaded section *6a*. The engaging piece 8 is fixed to the door stop support 3.

If the spindle 6 is turned it carries out a longitudinal movement in the adjustment support 5. Because of the differing thread pitches of the threaded sections *6a* and *6b* the retaining piece 7 moves a shorter distance. In this way a very delicate adjustment in the height of the door stop support 3 relative to the door body 1 can be achieved.

As can be seen from FIG. 1, the door body 1 is provided with a levelling opening 9 which can be closed by a levelling closure which is not shown. Corresponding levelling openings 10 and 11 respectively are provided in the door stop support 3 and in the door stop 2.

With a view to the possibility of relative displacement between the door body 1 and the door stop support 3 as explained with the aid of FIG. 3, care must be taken in the region of the levelling opening to ensure a gas-tight closure between the door body 1 and the door stop 3 in different relative positions of these parts. For this purpose an elastic compensator 12 is provided which is connected on the one hand to the door body 1 and on the other hand to the door stop support 3 by means of screws 13 and 14 respectively. On the inside of the levelling opening, the compensator 12 is protected by a protective pipe 15 which is for example fixed to the door body 1 and slidably movable relative to the door stop 2 and the door stop support 3.

A sealing element 17 which runs around the whole periphery of the coke oven door and is rounded at the corners serves to seal the gap 16 between the door stop carrier 3 and the door frame 4. It consists essentially of a metal sealing strip 18 having a bearing surface wich comes to rest against the door frame 4 and a lid-shaped or crowned resilient metal diaphragm 19. This diaphragm 19 is clamped at its inner edge on the door stop support 3 by means of the screws 14 mentioned above and carries the sealing strip 18 on its outer edge. The sealing strip 18 and the diaphragm 19 are advantageously constructed in one piece. The diaphragm 19 is shaped (that is to say curved like a lid) in such a way that when the sealing strip 18 is pressed onto the door frame 4 the diaphragm 19 is resiliently deformed causing the strip 18 to tip or rock from the position shown in FIG. 1 to the position shown in FIG. 2 and produce a wedge-shaped gap 20 (angle $\alpha$) between its outer edge and the surface of the door frame 4. Also when the sealing strip 18 is pressed onto the door frame 4 the sealing strip 18 moves outwards, i.e. in the direction of the arrow 21 in FIG. 2. As a result of this movement of the sealing strip 18 in the direction of the arrow 21 tarry condensation residues present on the surface 23 of the door frame 4 are introduced through the wedge-shaped gap 20 into a groove 22 formed in the bearing surface of the sealing strip 18. The tarry material 24 which is automatically taken up in this way by the sealing strip 18 forms a reliable seal of the gap between the door stop support 3 and the door frame 4 immediately after the sealing strip 18 has been pressed onto the door frame 4, (i.e. immediately upon clamping and locking of the coke oven door).

In order to limit the resilient deflection of the diaphragm 19 a rigid stop 25 is provided which is clamped together with the diaphragm 19 on the door stop support 3. This stop 25 only covers a part of the diaphragm 19 adjoining the clamping zone so that the outer part of the diaphragm 19 can be deformed to the extent resulting from the relative movement between the door body 1 and the door stop support 3 on the one hand and the door frame 4 on the other hand (on clamping and locking of the coke oven door).

An adjustment of the pressure with which the sealing strip 18 bears upon the door frame 4 when the coke oven door is in the closed condition is possible by means of the adjustment arrangement explained in connection with FIG. 3. By rotation of the spindle 6 the relative position between the door body 1 and the door stop support 3 supporting the sealing element 17 can be adjusted and with it the effective sealing strip pressure.

In order to limit the relative movement between the door body 1 and the door frame 4 occurring on clamping and locking of the door body, fixed stops (which are optionally adjustable) can also be provided.

As a variant of the embodiment illustrated in FIG. 1 it is also possible to connect the closure of the levelling opening not (as in the embodiment according to FIG. 1) to the door body 1 but to the door stop support 3. In this case the compensator 12 is omitted.

The sealing means according to the invention as described above is particularly suitable for vertical flue coke ovens and both for the coke side and the machine side of these ovens.

We claim:

1. In a coke oven having a doorway enclosed by a door frame, a door body movable between positions in which it selectively opens and closes said doorway, a door stop, a door stop support carried by said door body, and a metal sealing element having a bearing surface, said sealing element being supported by the door stop and encircling the door body in a position to bear against the door frame via and said bearing surface when the door body is in its doorway closing position and seal a gap between the door frame and the door body, the improvement wherein said sealing element is fixed at one edge of a continuous resilient metal diaphragm having its opposite edge secured to said door stop support, said bearing surface having a groove therein, said diaphragm being deformable in response to engagement of said sealing element with said door frame, the deformation of said diaphragm causing said bearing surface to tip and form a wedge-shaped gap between an outer portion of said sealing element and said door frame that is open in a direction away from the interior of said oven, said wedge-shaped gap being in communication with said groove in said bearing surface.

2. The coke oven according to claim 1 wherein the sealing element and the diaphiagm are constructed so that the deformation of said diaphragm effects movement of said sealing element relative to said door frame and in a direction away from the interior of said oven.

3. The coke oven according to claim 1 including stop means engageable with said diaphragm to limit deformation thereof.

4. The coke oven according to claim 3 wherein said stop means extends from adjacent said opposite edge of said diaphragm toward said one edge thereof but terminates short of said one edge.

5. The coke oven according to claim 1 wherein said groove is V-shaped.

6. The coke oven according to claim 1 wherein said diaphragm and said sealing element are unitary.

7. The coke oven according to claim 1 including adjusting means for varying the force with which said sealing element bears against said door frame.

8. The coke oven according to claim 7 wherein said adjusting means reacts between said door body and said doorstop support.

* * * * *

UNITED STATES PATENT AND TRADEMARK OFFICE

CERTIFICATE OF CORRECTION

PATENT NO. : 4,741,808

DATED : May 3, 1988

INVENTOR(S) : Wilhelm Holz et al

It is certified that error appears in the above-identified patent and that said Letters Patent is hereby corrected as shown below:

Column 1, line 59, change "aof" to -- of -- .

Column 4, line 4,delete the word "and" ; line 21, change "diaphiagm" to -- diaphragm -- .

Signed and Sealed this

Twentieth Day of September, 1988

*Attest:*

DONALD J. QUIGG

*Attesting Officer*

*Commissioner of Patents and Trademarks*